US011413661B2

(12) United States Patent
Gmeilbauer

(10) Patent No.: US 11,413,661 B2
(45) Date of Patent: Aug. 16, 2022

(54) SYSTEM FOR OUTPUTTING A MIXTURE

(71) Applicant: Engelbert Gmeilbauer, Seefeld (DE)

(72) Inventor: Engelbert Gmeilbauer, Seefeld (DE)

( * ) Notice: Subject to any disclaimer, the term of this patent is extended or adjusted under 35 U.S.C. 154(b) by 153 days.

(21) Appl. No.: 16/477,346

(22) PCT Filed: Jan. 12, 2018

(86) PCT No.: PCT/DE2018/100020
§ 371 (c)(1),
(2) Date: Jul. 11, 2019

(87) PCT Pub. No.: WO2018/130250
PCT Pub. Date: Jul. 19, 2018

(65) Prior Publication Data

US 2019/0374981 A1 Dec. 12, 2019

(30) Foreign Application Priority Data

Jan. 12, 2017 (DE) ..... 10 2017 100 567.6

(51) Int. Cl.
*B08B 3/02* (2006.01)
*B08B 1/00* (2006.01)
(Continued)

(52) U.S. Cl.
CPC ..... *B08B 3/026* (2013.01); *A47L 11/4088* (2013.01); *B05B 7/00* (2013.01);
(Continued)

(58) Field of Classification Search
None
See application file for complete search history.

(56) References Cited

U.S. PATENT DOCUMENTS 3,796,376 A * 3/1974 Farnsteiner ..... B05B 7/0087 239/353
4,222,521 A 9/1980 Nielsen
(Continued)

FOREIGN PATENT DOCUMENTS

DE 3400568 7/1985
DE 20 2006 002 469 U1 4/2006
(Continued)

OTHER PUBLICATIONS

Machine Translation of KR 2010/0021113 (Year: 2010).*
(Continued)

*Primary Examiner* — Michael D Jennings
(74) *Attorney, Agent, or Firm* — Tucker Ellis LLP; Michael G. Craig

(57) ABSTRACT

The invention relates to a system for outputting a mixture generated from at least one gas flow and at least one fluid flow onto a surface (50). The mixture (14) can be fed into a device (7) for outputting the mixture (14). The device (7) for outputting the mixture (14) comprises a gas-carrying line (2) in the interior (39) of which a fluid-carrying line (5) extends axially. The gas-carrying line (2) and the fluid-carrying line (5) are implemented as an outlet device (4) for outputting the mixture (14). The outlet device (4) is further implemented so as to be eccentrically rotatable about the longitudinal axis (12) of the gas-carrying line (2) and further comprises a body (59) for cleaning the surface (50).

12 Claims, 10 Drawing Sheets

Figure 1:
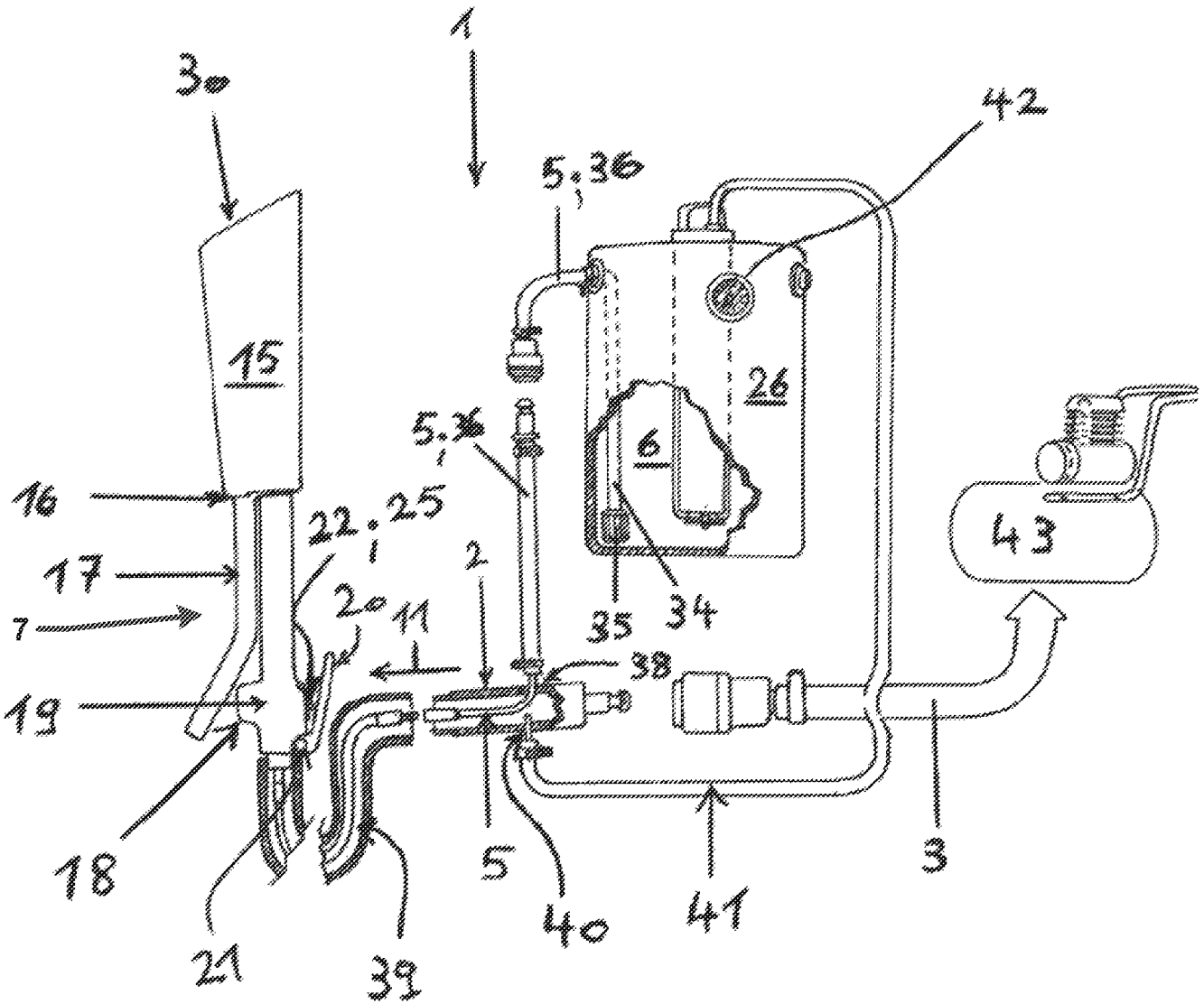

(51) Int. Cl.

| | |
|---|---|
| ***B08B 5/02*** | (2006.01) |
| ***B05B 7/00*** | (2006.01) |
| ***A47L 11/40*** | (2006.01) |

(52) U.S. Cl.
CPC ..... *B08B 1/002* (2013.01); *B08B 3/028* (2013.01); *B08B 5/02* (2013.01); *A47L 11/4083* (2013.01)

(56) References Cited

U.S. PATENT DOCUMENTS

| | | | | |
|---|---|---|---|---|
| 9,421,560 | B2 * | 8/2016 | Conrad | B05B 1/005 |
| 2010/0320289 | A1 * | 12/2010 | Kuo | B05B 7/2435 239/290 |
| 2012/0286065 | A1 * | 11/2012 | Lin | B05B 3/0409 239/225.1 |
| 2013/0001318 | A1 * | 1/2013 | Sendo | B05B 3/02 239/104 |
| 2014/0008457 | A1 * | 1/2014 | Bosua | B05B 3/02 239/104 |
| 2015/0000705 | A1 * | 1/2015 | Dehn | B05B 3/06 134/21 |
| 2015/0266041 | A1 * | 9/2015 | Liao | B05B 1/005 |

FOREIGN PATENT DOCUMENTS

| | | | |
|---|---|---|---|
| DE | 202013101261 | | 5/2013 |
| DE | 10 2012 110 844 | A1 | 5/2014 |
| FR | 1332196 | | 12/1963 |
| KR | 20100021113 | A * | 2/2010 |
| NL | 261473 | | 5/1964 |

OTHER PUBLICATIONS

Written Opinion of the Intl. Search Authority—PCT/DE2018/100020; 7 pages; dated Jul. 19, 2018.
International Search Report; PCT/DE2018/100020; 3 pgs.; dated Apr. 16, 2018.

* cited by examiner

SYSTEM FOR OUTPUTTING A MIXTURE

The invention relates to a system for cleaning objects according to the preamble of claim 1.

PRIOR ART

A tool holder for a steam vacuum device is known from DE 10 2012 110 844 A1. The tool holder comprises a suction inlet and a suction line fluidically connected to the suction inlet for suction air.

The tool holder further comprises a steam outlet and a steam line connected to the steam outlet.

Further systems for cleaning objects known from the prior art comprise a fluid container mounted on the handle. Said arrangement is disadvantageous because the arm of the user quickly becomes fatigues due to the increased weight of the handle.

It is difficult to precisely guide the cleaning device by means of the handle having the fluid tank disposed thereon.

OBJECT OF THE INVENTION

The object of the present invention is therefore to eliminate such disadvantages of known systems for cleaning objects.

A further object of the invention is to provide a system for cleaning objects wherein a mixture of compressed air and fluid can be mixed together as needed.

A further object of the invention is to produce a cleaning system whereby the intensity of the cleaning can be adjusted to the degree of soiling.

A further object of the invention is to provide a system for cleaning objects by means of which the loosened dirt particles and/or the cleaning fluid can be removed from the cleaned object after applying the cleaning fluid.

The system comprises according to the invention a line for carrying air, preferably compressed air. It is assumed below for simplification that the line carries compressed air.

The compressed air is fed through the air line to an outlet device for releasing the compressed air.

The outlet device is a preferably tube-shaped, cylindrical tube. The outlet device can be implemented as a funnel. The outlet device can have a round, oval, rectangular, or any other cross section.

A fluid line is disposed at least in areas in the interior of the air line, in which the fluid can be carried within the air line in the direction of the outlet device. In general, the term "fluid" refers to a free-flowing gas or a liquid. In conjunction with the invention, the term fluid refers to a liquid, free-flowing medium.

A valve device comprising at least two valves is provided.

One valve controls the inflow of the air, preferably the compressed air, in the direction toward the outlet device, while the other valve controls the inflow of the fluid, preferably the cleaning agent, in the direction toward the outlet device.

The at least two valves regulate the volume and/or the pressure of the compressed air in the air line relative to the volume and/or the pressure of the fluid in the fluid line.

According to the invention, the at least two valves can be actuated individually or together.

The air line opens into a connecting flange together with the fluid line extending in the interior of the air line.

The connecting flange thereby extends axially in the flow direction of the compressed air and is disposed radially rotatably about the longitudinal axis thereof.

The rear end of the connecting flange as seen in the flow direction of the compressed air opens into an outlet device.

The outlet device comprises an opening on the end facing away from the connecting flange. The air, preferably the compressed air, flows into the outlet device on the flange-side end and is released through the opening of the outlet device.

The fluid line extends axially at least in sections in the interior of the connecting flange and/or in the interior of the outlet device.

The fluid carried in the fluid line, preferably the cleaning agent, is released out of the fluid line at least in sections in the connecting flange and/or in the outlet device.

The released fluid is captured and carried along by the compressed air flow in the connecting flange and/or in the outlet device. The mixture of compressed air and fluid formed in this manner in the connecting flange and/or in the outlet device escapes through the opening of the outlet device into the device for outputting the mixture.

According to the invention, the outlet device rotates radially with the connecting flange about the longitudinal axis of the fluid line.

The outlet device comprises at least one end relative to the longitudinal axis of the connecting flange. Because of the at least one bend, the outlet device ends eccentric to the longitudinal axis of the connecting flange, so that the mixture of compressed air and fluid escapes from the outlet device into the device for outputting the mixture eccentric to the longitudinal axis of the connecting flange.

According to the invention, the system for cleaning objects comprises a device for outputting the mixture. The device for outputting the mixture can have the form of a spout-shaped tube profile enclosing with a seal the air line and/or the fluid line.

The spout-shaped tube profile overlaps the air line and/or the connecting flange and/or the outlet device axially and radially, at least in sections, in the flow direction of the compressed air.

At least in sections, the device for outputting the mixture, preferably the tube profile, comprises a spout shape having a radial extent. The connecting flange is disposed radially rotatably about the longitudinal axis thereof in the device for outputting the mixture.

The outlet device connected to the connecting flange can rotate eccentrically about the longitudinal axis of the connecting flange with the fluid line extending into the interior of the outlet device.

According to the invention, the device for outputting the mixture comprises a further flange to which at least one suction tube, particularly of a vacuum cleaner, can be coupled.

According to the invention, the system has a housing enclosing the air line and/or the gas-carrying line and/or the at least two valves and a handle.

Housing

The housing can be made of plastic or of metal and can preferably be opened by means of at least one quick-connect for maintenance and/or repair purposes.

The housing preferably comprises at least one rubber seal for sealing the components individually housed in the housing against one another and against the compressed air and/or against the fluid.

The individual components of the housing, such as the air line and/or the fluid line and/or the valve device can be coupled to the housing in a modular manner and disconnected from the same again.

The arrangement of the air line and/or the fluid line in the housing is implemented such that the transport of the compressed air and the fluid runs in a straight line. This has been found to be advantageous because the housing is technically easier to produce and the transport of the compressed air and/or fluid can use less energy.

The modular construction of the housing increases the variability of the system because the system can be combined with components of other cleaning systems for cleaning objects.

A further advantage is that the housing releasably connects the air line and/or the fluid line and/or the suction tube to each other.

The housing is implemented so that the air line, the housing itself, or at least one of the other components listed above can be used as a handle and/or is implemented as a handle. An additional handle component is therefore not required, which has a positive effect on the production costs.

The housing is implemented, however, such that a handle element can be preferably releasably coupled to the housing of the system at an angle to the longitudinal axis of the connecting flange, depending on the need and purpose of application.

The outer circumference of the housing and/or the handle can be profiled and/or roughened and/or smoothed and/or coated. Profiling is assumed below as an example and is not exclusive. The profiling is preferably implemented as ribs or fillets spaced apart from each other.

The profiling prevents cold or heat being transferred to the hand of the user from the air line and/or the fluid line.

To increase operator comfort, the housing can comprise cutouts for guiding the hand of the user.

The top side and/or bottom side and/or side walls of the housing can comprise switches for controlling the system for cleaning objects, and particularly for controlling the at least two valves.

At least one pump can be connected to the housing for bringing about the transport of the fluid and/or the compressed air in the associated line and for building up the corresponding line pressure.

Each pump can be preferably electrically driven by means of a rechargeable battery.

Valve Device

According to the present invention, the term "valve" means a component particularly for blocking off, releasing, or controlling the flow rate of compressed air and/or of a fluid in the associated line.

In the air line or the fluid line, the compressed air flow or fluid flow can be increased, reduced, or interrupted with respect to the volume transported. To this end, a closing part is pressed against a suitably formed opening.

The valve disposed in the fluid line and the valve disposed in the air line can each individually or together be shutoff valves, flow valves, backflow valves, pressure valves, or directional valves. Of course, the above list contains only examples and is not intended to be comprehensive in any way.

The at least two valves can have manual or electrical switches.

A common switch, preferably a switch lever, can be provided, by means of which the at least two valves can be actuated simultaneously or in time sequence. The two valves for actuating simultaneously or in time sequence first actuate the compressed air line and then the fluid line, or vice versa.

At least two separate switch levers of a single switch for operating independently of each other can also be disposed.

The two switch levers of the valve can be equal in size, or can have different sizes. The two switch levers can comprise a different outer profile, so that the user can actuate the two switch levers on the basis of haptic differences alone, without having to observe the switch levers.

The switches can also be disposed spatially separated from each other on different sides of the housing. For example, the switch controlling the compressed air flow can be disposed on the top side of the housing, while the switch controlling the fluid flow in the fluid line is provided on the side wall of the housing.

Of course, the switches can also be mounted on other locations of the housing.

One single switch lever can be disposed on the housing, by means of which the valve for controlling the compressed air flow can be actuated first, and which subsequently actuates the other valve by means of which the fluid flow can be controlled.

To this end, the switch lever can be implemented such that when manually actuating the valves, a protruding profile is provided on the switch lever, first triggering the one and then the other valve switch when the switch lever is actuated.

The valve switches can also, however, be disposed such that the joint switch lever first actuates the switch lever disposed at a higher elevation when actuated and subsequently actuates the switch lever positioned at the lower elevation.

The axes of the at least two valve switches can be positioned approximately parallel to a pivot axis of the switch lever. The valve switch of the compressed air valve and the valve switch of the fluid valve can also be disposed at an angle to the pivot axis of the switch lever.

The contact surface of the switch lever, making contact with the valve switches for actuating the valve switches, can be profiled such that when the switch lever is actuated, the two valve switches are actuated one after the other.

Two valve switches can also be provided and disposed such that the one valve switch switches the compressed air valve separately and independently of the fluid valve, for example. The other valve switch can switch the fluid valve, for example, only in such a way that actuating the fluid valve requires prior actuation of the compressed air valve.

Actuating the two valve switches at different times can also be brought about in that the spatial height of the contact surface relative to the longitudinal axis of the connecting flange of the one valve switch deviates from the spatial height of the contact surface relative to the longitudinal axis of the connecting flange of the other valve switch.

Of course, the time sequence of actuating the compressed air valve relative to the fluid valve and vice versa can be programmed and adjusted electronically or in any other manner.

Predetermined and actuating the compressed air transport preferably first relative to actuating the transport of the fluid in the fluid line has the advantage that preferably a cleaning fluid is atomized in the compressed air flow or can be applied to the surface to be cleaned as a cleaning mist.

The proportion of cleaning agent in the compressed air flow can also be adapted to the current level of soiling.

Mixture of Compressed Air and Fluid

By controlling the admixture of the fluid, preferably of a cleaning fluid, into the gas flow, preferably the compressed air, the metering of cleaning agent in the compressed air flow can be varied and adapted to the current degree of soiling of the surface to be cleaned.

The cleaning agent is thereby used in a particularly frugal manner appropriate to the need. In addition, besides varying the amount of fluid, the amount and intensity of compressed air can preferably also be varied. The effectiveness of the cleaning agent on the surface to be cleaned can thereby also be varied.

The atomizing and/or misting of the cleaning agent in the compressed air flow can be optimized in this manner.

The pressure applied to the air line and/or to the fluid line can be increased or decreased as needed. The intensity of swirling of the mixture of compressed air and fluid in the spout-shaped tube profile can thereby be optimized.

Gas-Carrying Line

Downstream in the flow direction of the compressed air, a gas-carrying line is removably connected to the housing. The gas-carrying line can be made of plastic or of metal or of a fabric hose. The gas-carrying line carries at least one gas, particularly compressed air, through the gas-carrying line in the direction toward the connecting flange.

According to the invention, the term "gas" preferably means air, particularly comprising the components of nitrogen and oxygen. Of course, other components can also be present in the gas.

A compressor can be provided for generating the compressed air.

The pressure to be applied to the gas-carrying line can be generated by a pump for connecting to the gas-carrying line.

Alternatively, the pressure can also be applied to the gas-carrying line by coupling to a conventional vacuum cleaner.

Any manner of generating pressure can also be used in order to produce the required pressure in the gas-carrying line.

The alternative potential means for generating compressed air in the associated gas-carrying line further enable combining the system for cleaning objects with other equipment, such as a vacuum cleaner. Fundamentally, any pressure-generating source can be used as necessary for generating the pressure required in each case.

With respect to the flow direction of the compressed air, the housing can be disposed at the upper end of the gas-carrying line as seen in the flow direction. The housing and/or the components received therein can also be disposed at the downstream end of the compressed air line with respect to the flow direction of the compressed air.

Alternatively, the housing can be placed in the compressed air line.

The gas-carrying line comprises a segment comprising the outlet device. Said segment is separated from the other, upstream segment of the gas-carrying line.

The segment of the gas-carrying line comprising the outlet device is displaceable in the axial direction against the other, upstream segment of the gas-carrying line. The spacing between end faces facing each other of the other, upstream segment of the gas-carrying line and the segment of the gas-carrying line comprising the outlet device can be axially changed.

The other, upstream segment and the segment comprising the outlet device are designed for connecting axially to each other in a gas-tight manner by means of a connecting flange.

The end faces of the two segments of the gas-carrying line facing each other protrude into the connecting flange. The segment of the gas-carrying line comprising the outlet device is disposed in the interior of the connecting flange for displacing relative to the other segment of the gas-carrying line in a gas-tight manner. For sealing the segment comprising the outlet device against the connecting flange, a sealing means can be disposed on the inner wall of the connecting flange.

The fluid line comprising no interruptions extends in the interior of the gas-carrying line. The fluid line bridges the end faces of the segments of the gas-carrying line in the interior of the connecting flange.

The segments running in the interior of the connecting flange and the fluid line are shown as dashed lines.

Fluid Line

A fluid line extends in the interior of the gas-carrying line.

The fluid line is disposed in the interior of the gas-carrying line and spaced apart from the inner wall of the gas-carrying line by means of spacers. The fluid line can, however, also run in the wall of the gas-carrying line, or particularly be materially connected to the wall of the inner side of the gas-carrying line.

The fluid line has a diameter less than the inner diameter of the gas-carrying line, so that the compressed air flowing through the gas-carrying line flows along the outer circumference of the fluid line.

The fluid line can be constructed of a fabric material or made of a plastic material or of metal. Of course, the fluid line can also be made of a different material.

A fluid, particularly a liquid, a cleaning fluid, or a gas flows in the fluid line.

Fluid Tank

The fluid is preferably transported by a pump or another device from a fluid tank in the flow direction of the compressed air in the direction toward the outlet device.

In the region of the connecting flange and/or in the region of the outlet device, the fluid line comprises means for releasing the fluid into the surrounding gas-carrying line.

The means for releasing within the fluid line are preferably openings, cracks, or penetrations. Other technical devices can also be provided for facilitating injecting or applying fluid into the compressed air flow.

Compressed air can be fed from the compressed air line into the fluid tank for applying pressure to the fluid in the fluid line.

Depending on the pressure to be applied to the fluid line, the pressure in the fluid tank can be increased or decreased. In addition, any other technical device for applying pressure to the fluid line can be used.

The fluid tank can be carried by the user on the back like a backpack. The fluid tank can also be transportable in design, or placed on the floor. All other types of arrangement of the fluid tank can also be used.

The fluid tank can have a capacity of five liters of fluid, for example, particularly of cleaning agent.

The fluid can be a mixture of water and a cleaning agent.

The fluid tank can have a pressure of 3 bar applied as an example, and in no way exclusively.

Connecting Flange

The gas-carrying line is connected to the fluid line extending in the interior thereof at a connecting flange downstream in the flow direction of the compressed air.

The fluid line runs along the longitudinal axis of the connecting flange, through the connecting flange, and opens into an outlet device.

The connecting flange is disposed on the gas-carrying line radially rotatably about the longitudinal axis thereof.

The other end of the connecting flange is downstream with respect to the flow direction of the compressed air and is connected to the outlet device into which the fluid line protrudes.

At least one bearing, preferably a ball bearing, is provided so that the connecting flange is rotatably about the gas-carrying line radial to the longitudinal axis thereof.

Vanes are preferably disposed on the inner wall of the connecting flange.

The compressed air flow flowing into the connecting flange impinges on the vanes disposed at an angle to the compressed air flow, whereby the connecting flange is induced into a radial motion relative to the longitudinal axis thereof.

Of course, the connecting flange can also be induced to radial motion in any other technical manner.

The compressed air flows out of the connecting flange into the outlet device downstream in the flow direction of the compressed air.

The compressed air in the outlet device flows around the fluid line extending in the interior of the outlet device.

In the region of the connecting flange and/or in the region of the outlet device, the fluid line comprises means for releasing the fluid into the compressed air flowing along in the outlet device.

By flowing the fluid out of the fluid line by means of the means for releasing, the mixture of compressed air and fluid arises in the outlet device. The mixture of compressed air and fluid flows downstream in the flow direction in the outlet device toward the at least one opening of the outlet device.

Outlet Device

In the region in which the compressed air flows along the means for releasing the fluid from the fluid line in the outlet device, a vacuum arises in the outlet device, by means of which the compressed air flow continuously draws fluid out of the fluid line and transports the same.

An outlet device is rotationally fixedly connected to the back end of the connecting flange downstream in the flow direction of the compressed air.

By rotating the connecting flange about the longitudinal axis thereof, the outlet device is also induced to rotate about the longitudinal axis of the connecting flange.

The outlet device is bent at least once relative to the longitudinal axis of the connecting flange, so that the opening of the outlet device by means of which the mixture of compressed air and fluid can be released is aligned eccentric to the longitudinal axis of the connecting flange.

The at least single bend of the outlet device and the eccentric arrangement of the opening of the outlet device relative to the longitudinal axis of the connecting flange swirls the mixture of compressed air and fluid into the device for outputting the mixture, preferably into the spout-shaped tube profile.

The swirling takes place within the device for outputting the mixture radial to the longitudinal axis of the connecting flange and axial to the longitudinal axis of the connecting flange, forward in the direction toward the surface to be cleaned.

The advantage of this arrangement is that the swirled mixture of compressed air and fluid impinges on the surface to be cleaned at different intensities depending on the intensity of the pressure applied to the outlet device, and releases the dirt particles.

Depending on the soiling, the pressure in the compressed air line can be increased or decreased.

Depending on the design of the bends in the outlet device, an approximately round or oval swirling formation can arise.

The outlet device can comprise further openings. To this end, fittings are disposed on the sides of the outlet device, each for receiving a fluid line and each opening into a further opening through which the mixture of compressed air escapes into the device for outputting the mixture.

In this manner, additional swirling forms can be produced, whereby the cleaning intensity can be significantly increased.

Body for Mechanically Cleaning the Surface

The outlet device comprises a body for mechanically cleaning the surface.

The body is implemented as a brush. The body can also be a sponge or a wire construct for mechanically cleaning. The body can also be a different element for mechanically cleaning a surface.

The body is disposed on the outlet device.

The outlet device comprises a segment extending along the longitudinal axis of the gas-carrying line. The body for cleaning the surface is disposed on the segment of the outlet device extending along the longitudinal axis of the gas-carrying line.

The end of the body for cleaning the surface downstream in the axial direction does not protrude beyond the downstream end of the outlet device.

The outlet device further comprises a further segment connected downstream of the segment extending along the longitudinal axis of the gas-carrying line and extending eccentric to the longitudinal axis of the gas-carrying line.

The body for cleaning the surface (not shown) can also be disposed at the end of the further segment connected downstream and running eccentric to the longitudinal axis of the gas-carrying line.

The outlet device is connected to the connecting flange. A rotation of the connecting flange brings about a rotation of the outlet device. The rotation of the outlet device brings about rotation with the outlet device of the body disposed on the outlet device for cleaning the surface. The body for cleaning the surface rotates in the interior of an enclosure radially enclosing the outlet device.

An adapter (not shown) is disposed at the end of the enclosure. The enclosure is implemented as an enclosing tube profile.

The enclosure is radially rotatable relative to the housing (not shown). Conversely, the housing (not shown) can be disposed radially rotatably relative to the enclosure.

The arrangement of the body for mechanically cleaning the surface has been found to be advantageous because the cleaning of the surface by means of a mixture of gas and fluid can be supported in this manner by mechanically cleaning by means of a body for mechanically cleaning the surface.

Device for Outputting the Mixture

The device for outputting the mixture can have the form of a spout-shaped tube profile. The device can be made of plastic or of metal or of a different material.

The device can be releasably disposed on the housing or on a component of the housing. The device for outputting the mixture can preferably be disposed on the housing by means of a bayonet joint. Said device can also, however, be mounted on the housing in a different technical manner. The device for outputting the mixture can be disposed on a component of the housing, preferably on the compressed air line.

The device for outputting the mixture can have a circular or oval cross section. Said device can be cylindrical or can comprise a diameter expanding in the direction toward the outlet opening thereof.

A suction hose can be attached by means of a flange in the region of the end opposite the outlet opening of the device for outputting the mixture.

The suction hose can be flexible in design and can be made of a mesh. The suction hose can also be made of rubber, plastic, or metal.

The suction hose can be connected to a vacuum cleaner. By means of the suction hose, the dirt particles and/or the fluid, particularly the cleaning fluid and/or the compressed air can be suctioned off of the surface to be cleaned after the surface to be cleaned has been cleaned by the mixture of compressed air and fluid.

Lighting Element

At least one lighting element can be disposed in the interior of the device for outputting the mixture, preferably in the region of the outlet opening thereof.

The lighting element can be an LED luminous element or a different luminous element.

The lighting element can also be disposed on the outer side of the device for outputting the mixture.

For better illumination of the surface to be cleaned, the lighting element can emit black light.

Heating Element

At least one heating element can be provided, preferably in the interior of the device for outputting the mixture. The heating element can be implemented as a heating wire. Any other technical means for implementing a heating element can also be used.

The heating element is preferably disposed in the region of the outlet opening of the device for outputting the mixture. The heating element can be switched on automatically upon actuating the system for outputting the mixture. The lighting can, however, also be switched on and off selectively by the user.

The arrangement of a heating element has been found to be advantageous because the compressed air and/or the fluid can be heated before applying them to the surface to be cleaned, whereby the cleaning process is facilitated.

Switching on a heating element can be used for immediately drying off the surface to be cleaned in order to remove the applied fluid as quickly as possible from the cleaned surface.

Further advantages and embodiments of the invention can be seen in the following drawing.

Figure 2:
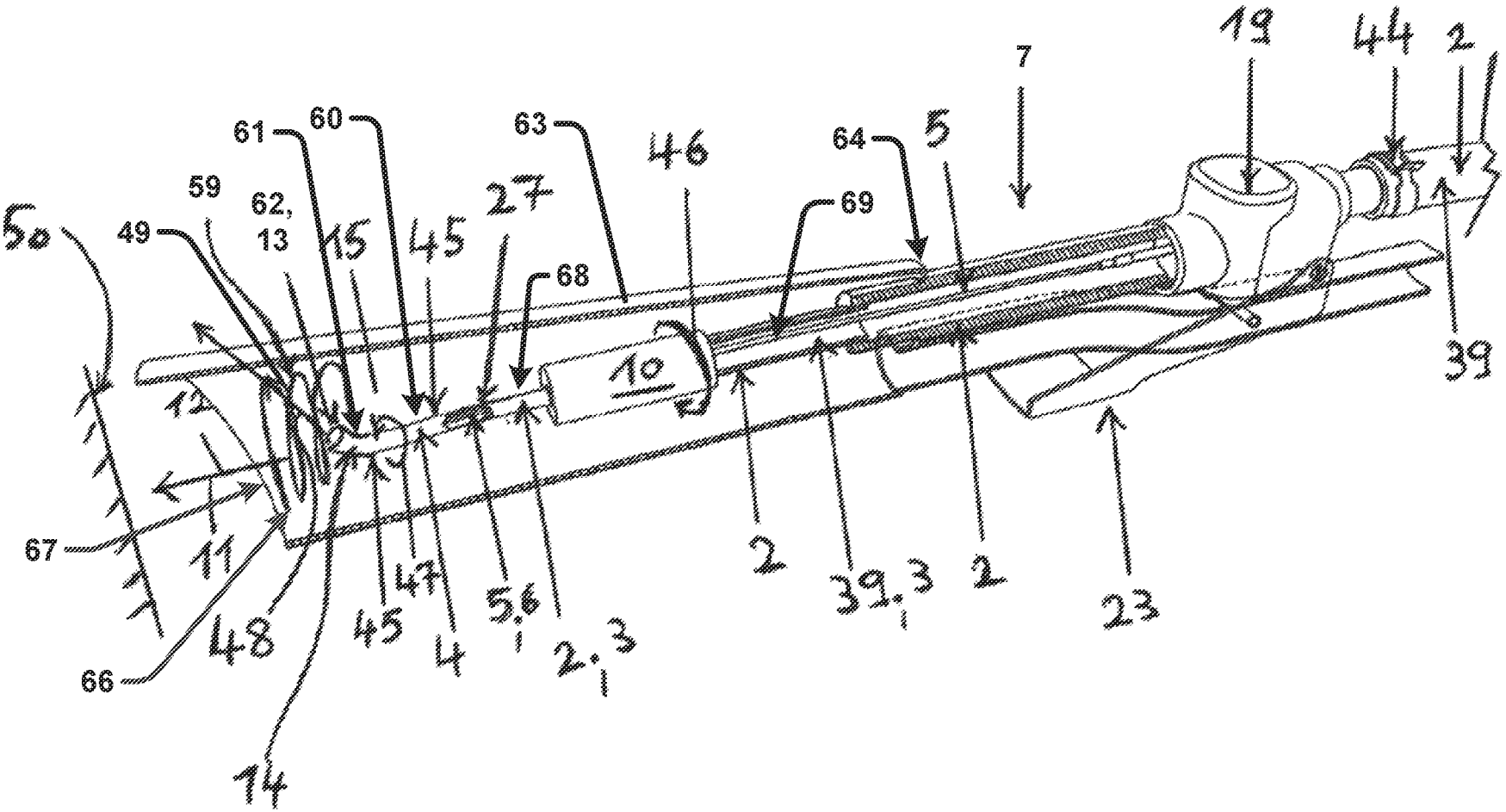
Figure 3:
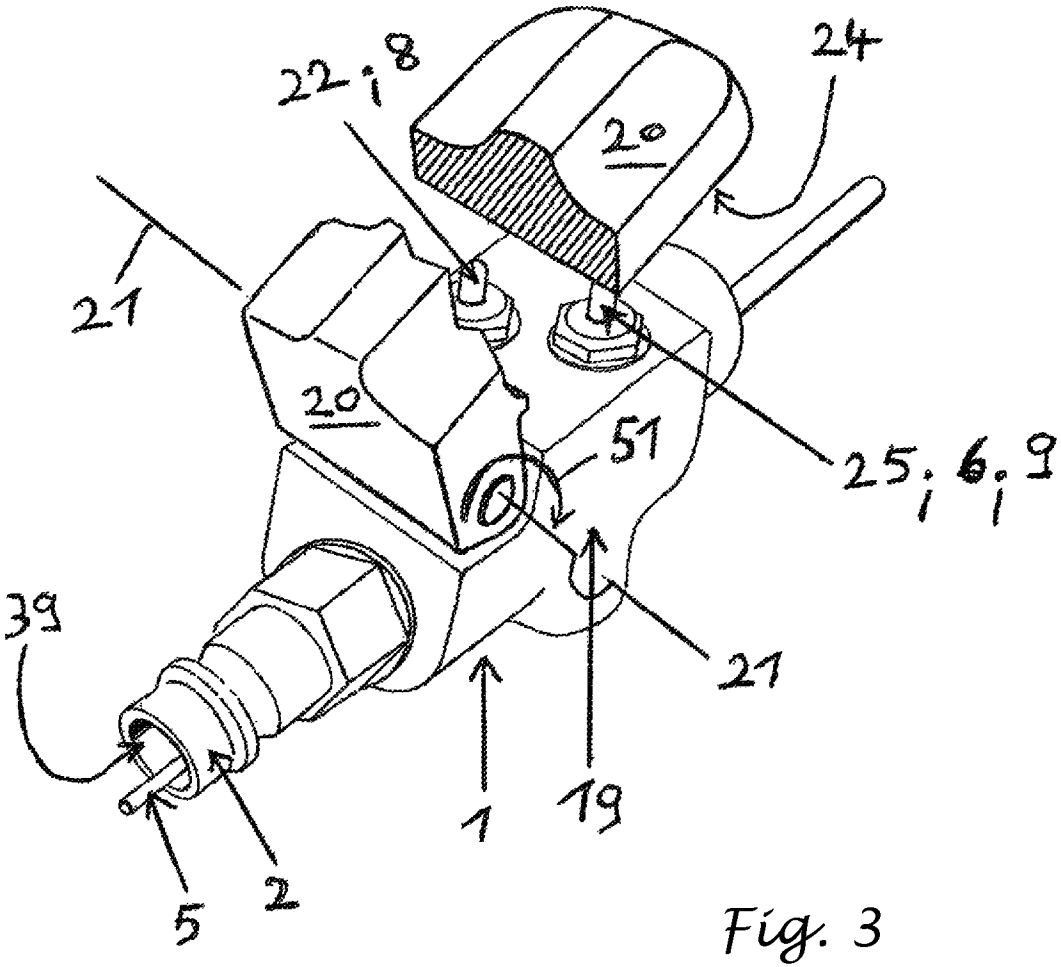
Figure 4:
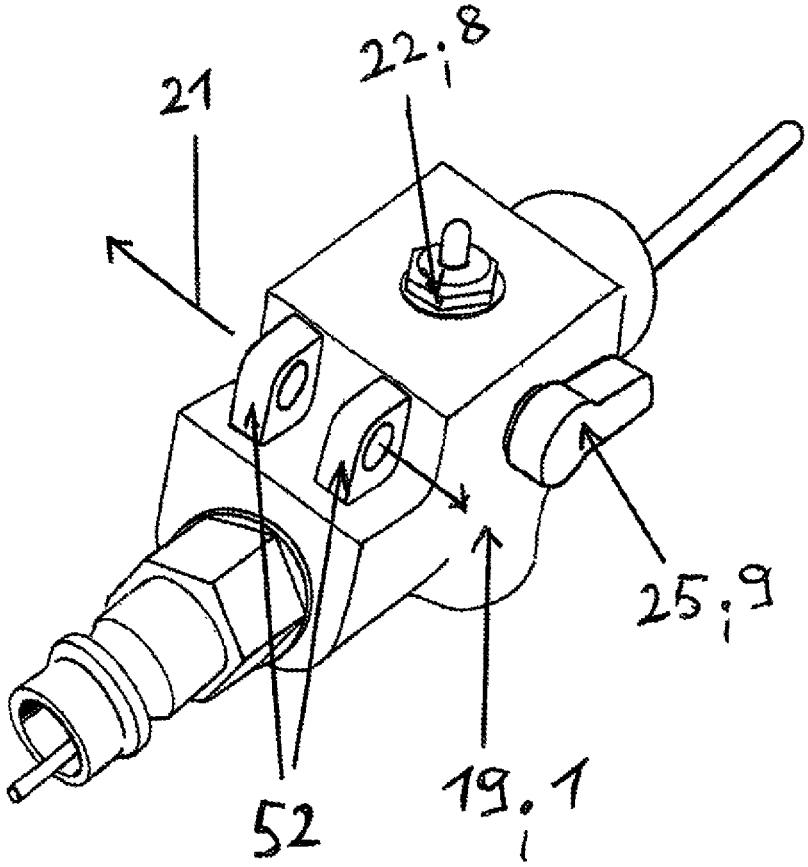
Figure 5:
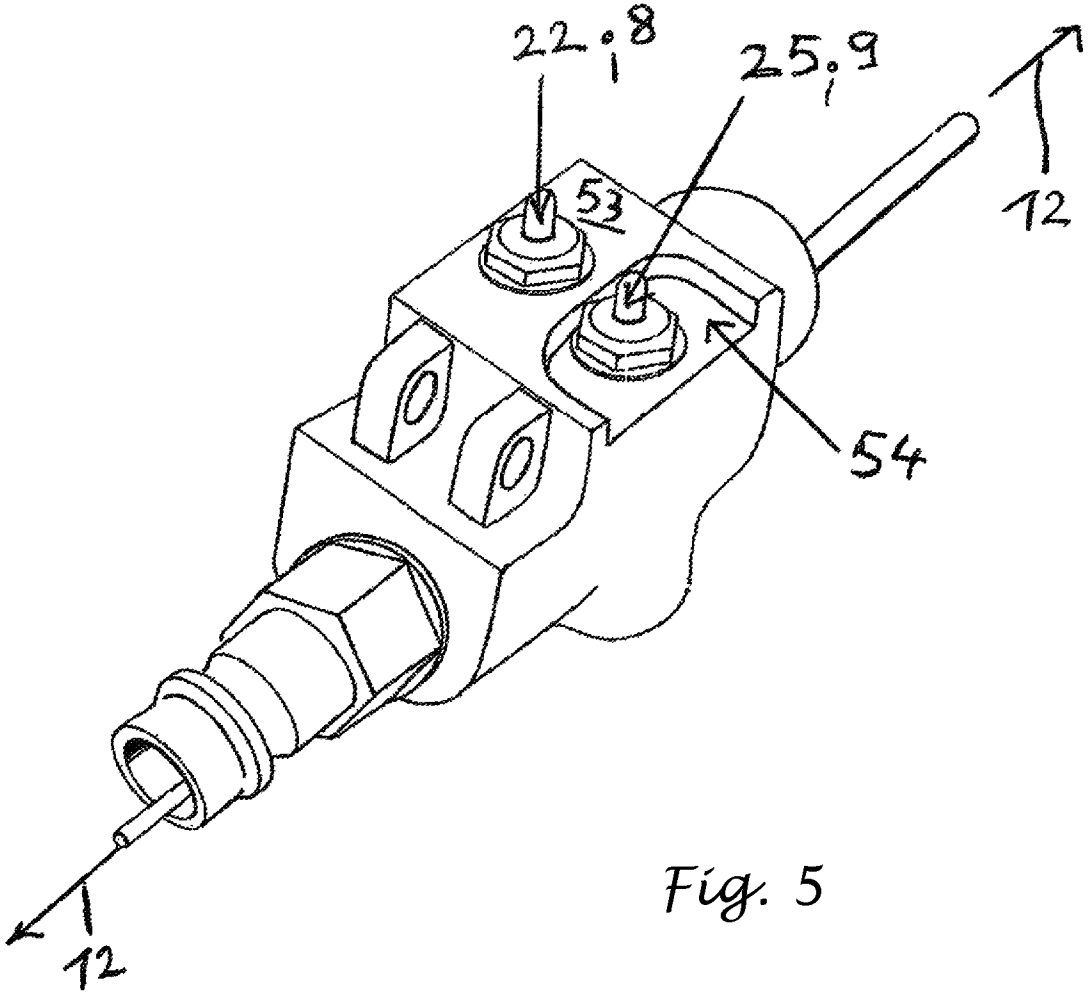
Figure 6:
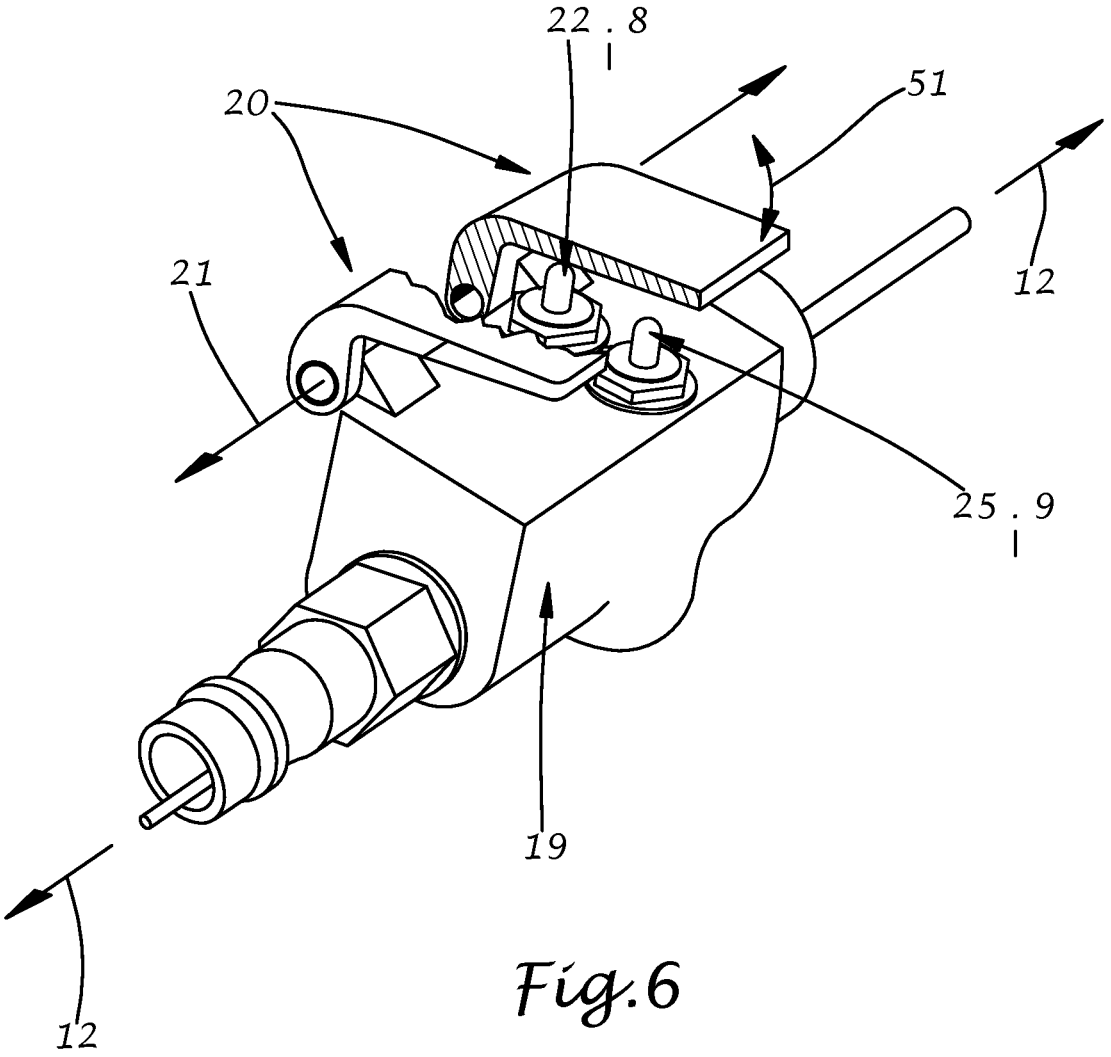
Figure 7:
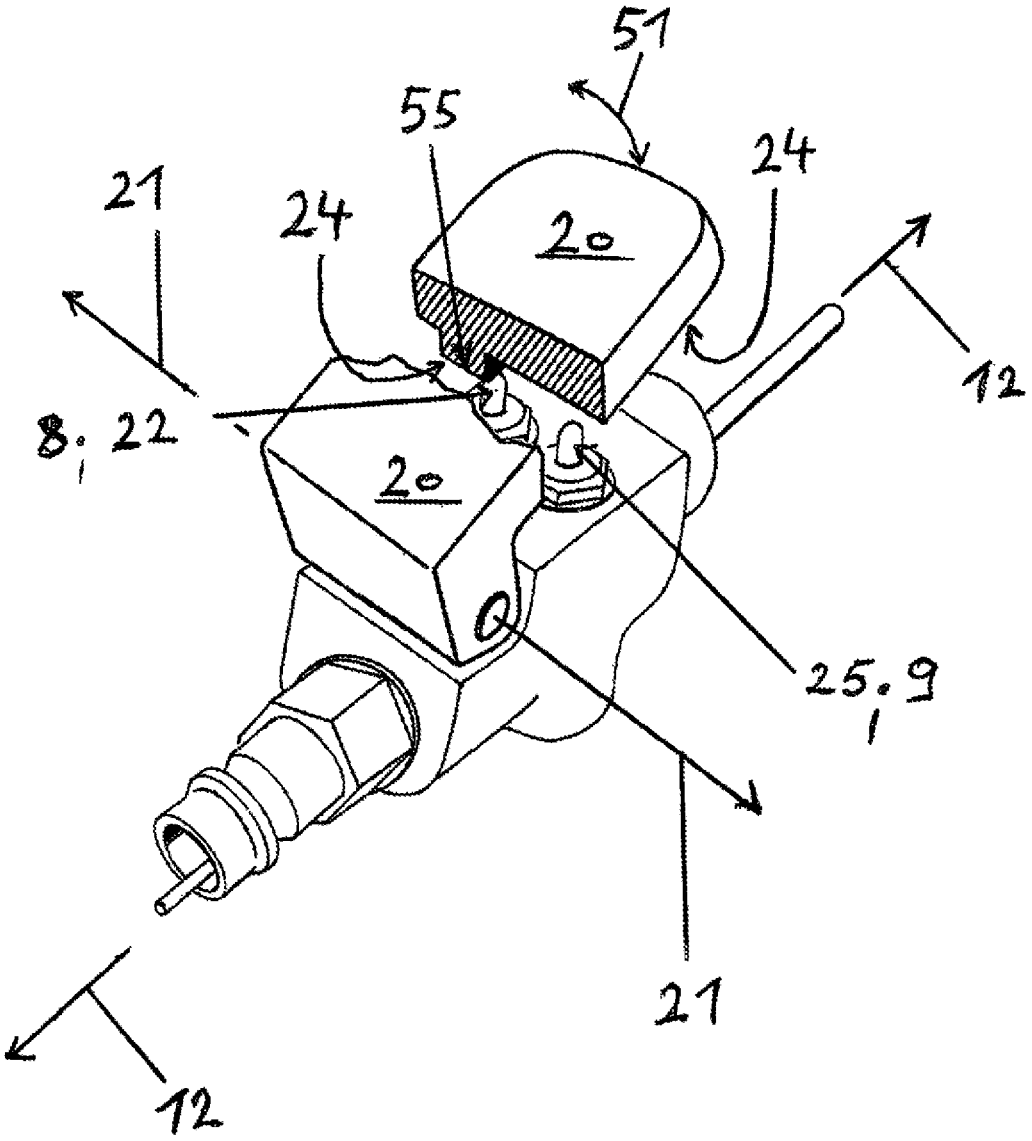
Figure 8:
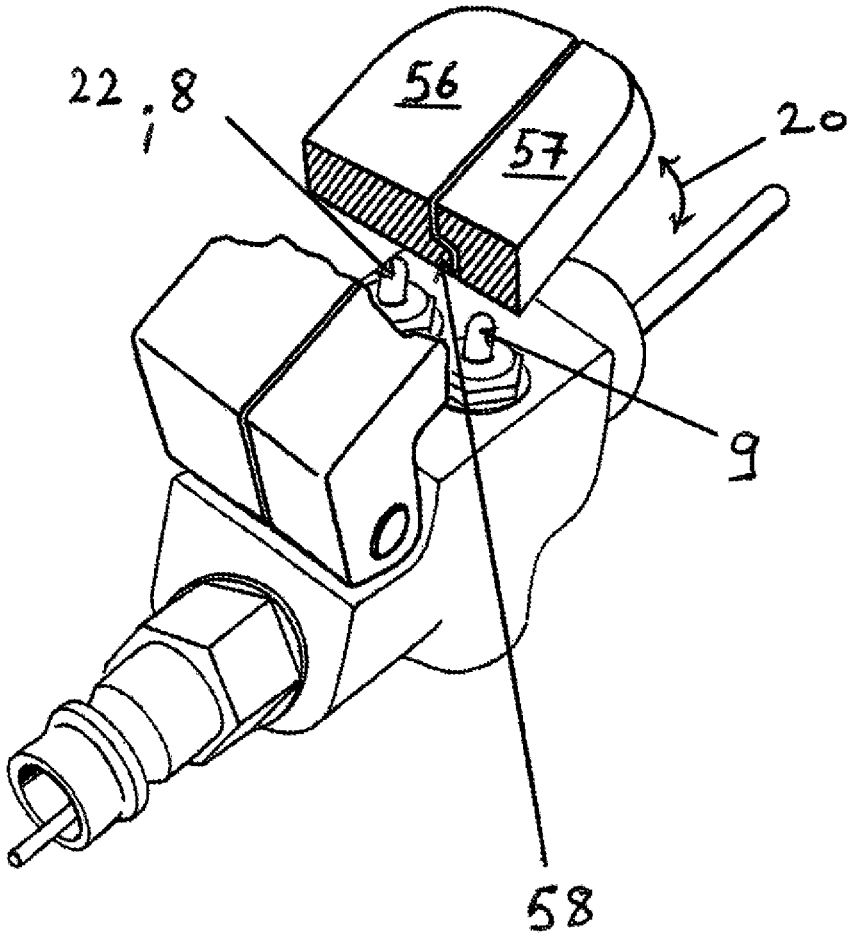
Figure 9:
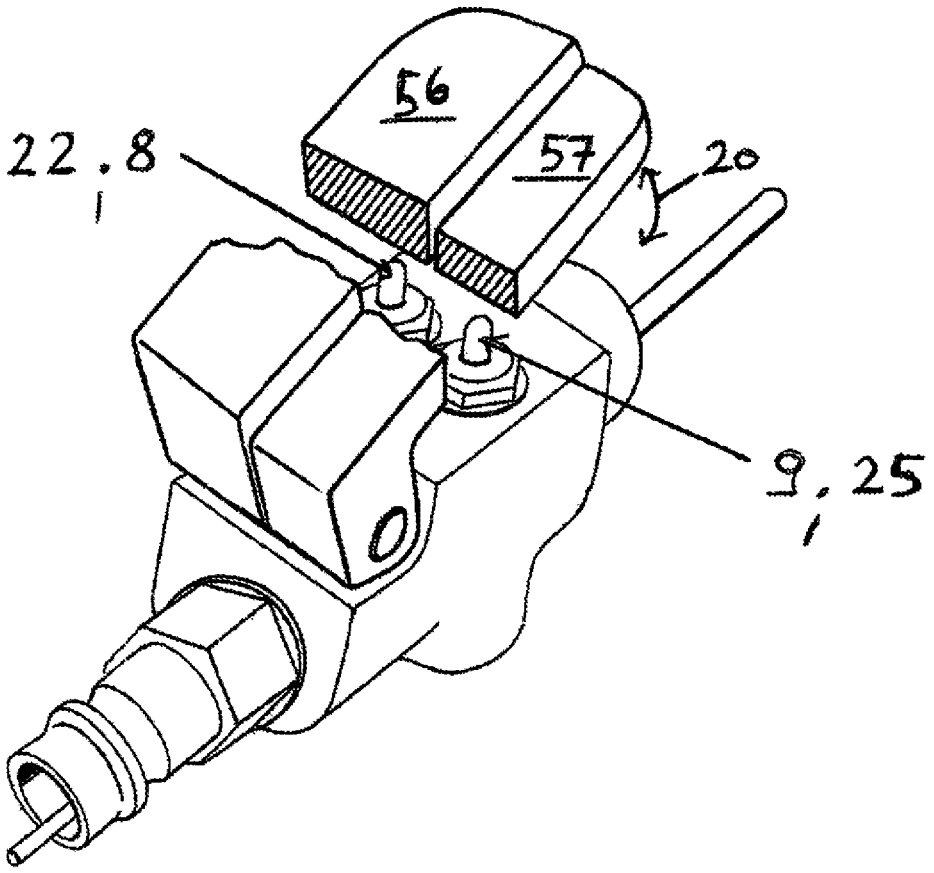
Figure 10:
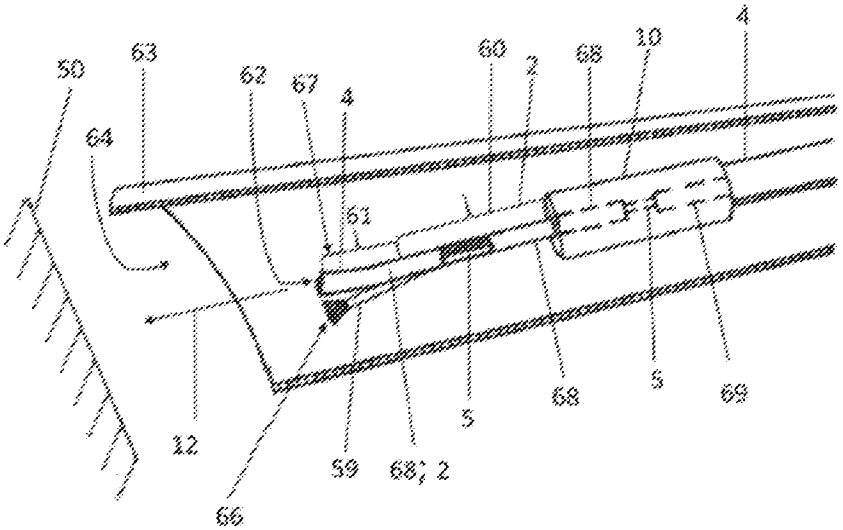

Shown are:

FIG. 1 A system for outputting mixtures,

FIG. 2 A housing of the system having a gas-carrying line and a device for outputting the mixture, FIG. 3 A housing of the system having two valve switches disposed offset from each other and a switch lever, FIG. 4 A housing according to FIG. 3 having valve switches disposed at right angles to each other, FIG. 5 The housing of the system for outputting mixtures having two valves disposed on different planes relative to each other, FIG. 6 the housing of the system having two valves and one pivoting valve switch, FIG. 7 A housing according to FIG. 6 having two contact surfaces of the valve switch disposed on different planes, FIG. 8 A housing according to FIG. 6 having two switch levers engaging in each other, FIG. 9 A housing according to FIG. 6 having two valve switches independent of each other, and FIG. 10 a detail from FIG. 2 having two segments of the gas-carrying line.

FIG. 1 shows a system 1 for outputting mixtures and having a gas-carrying line 2 and a fluid line 5 disposed in the gas-carrying line 2.

The fluid line 5 is fed with fluid from a fluid tank 26. To this end, a fluid line 5 is provided, having an upper end engaging in a fluid tank 26.

At the top end 34 thereof, the fluid line 5 comprises a filter for filtering out foreign matter from the fluid 6 before taking up the fluid 6 into the fluid line 5.

The fluid line 5 is made up of line elements 36 connected to each other by means of connecting flanges.

The fluid line 5 is introduced into the gas-carrying line 2 at an inlet 38.

The fluid line 5 is thereby sealed against the gas-carrying line 2, so that no compressed air 3 can escape through the inlet 38.

The fluid line 5 extends downstream in the flow direction 11 of the compressed air 3 in the interior 39 of the gas-carrying line 2.

The gas-carrying line 2 further comprises an outlet 40 connected to the fluid tank 26 by means of a supply line 41.

The supply line 41 is sealed relative to the gas-carrying line 2 in the outlet 40, so that no compressed air 3 can accidentally escape out of the outlet 40.

The supply line 41 applies compressed air 3 to the fluid tank 26.

By applying compressed air 3 to the fluid tank 26, the fluid 6 stored in the fluid tank 26 is pressed into the fluid line 5.

The cleaning fluid and the water are mixed in the fluid tank 26. By applying compressed air 3 to the fluid tank 26, the water disposed in the fluid tank 26 is mixed with the cleaning agent also present in the fluid tank 26.

A manometer 42 is provided for measuring the pressure within the fluid tank 26.

A generator 43 is shown in plan view on the right side of FIG. 1 and applies compressed air 3 to the gas-carrying line 2.

The fluid line 5 extends downstream in the flow direction 11 of the compressed air 3 in the interior 39 of the gas-carrying line 2.

The fluid line 5 assembled from the line elements 36, together with the gas-carrying line 2 enclosing the fluid line 5, opens into the housing 19 of the system 1 for outputting a mixture.

The housing 19 comprises a schematically depicted handle 18 on the bottom of the housing 19, opposite the top side of the housing 19, on which the valve switches 22; 25 of the valves 8; 9 (not shown) are disposed.

A switch lever 20 is depicted in FIG. 1 for actuating the valve switch 22; 25 and is pivotally mounted about a pivot axis 21.

The gas-carrying line 2 (not shown) runs within the housing 19 and the fluid line 5 runs in the interior of the gas-carrying line 2.

A spout-shaped tube profile 15 is shown in the schematic depiction of FIG. 1, downstream in the flow direction 11 on the gas-carrying line 2. At the end of the spout-shaped tube profile 15 facing away from the housing 19, the spout-shaped tube profile 15 comprises an outlet opening 30.

In FIG. 1, the spout-shaped tube profile 15 is angled in the region of the outlet opening 30 thereof.

The tube profile comprises an approximately conical form over the axial length of the spout-shaped tube profile 15, wherein the diameter of the device for outputting the mixture tapers down in the form of the spout-shaped tube profile 15 in the direction toward the outlet opening 30.

A suction tube 17 extends approximately parallel to the axis of the housing 19 at the ends of the spout-shaped tube profile 15 on the housing side 19.

The suction tube 17 is connected to the spout-shaped tube profile 15 by means of an additional flange 16.

The suction tube 17 is connected to a vacuum cleaner (not shown).

FIG. 2 shows a system 1 for outputting a mixture having a housing 19 connected to the gas-carrying line 2 by means of a clamp 44 as shown in the plan view on the right in FIG. 2.

The fluid line 5 (not shown) runs in the interior 39 of the gas-carrying line 2.

The fluid line extends through the housing 19 and exits the housing 19 on the downstream side in the flow direction 11 of the gas-carrying line 2 and enters the interior 39 of the gas-carrying line 2.

The gas-carrying line 2 carries the compressed air 3 that is pressurized as shown in FIG. 1.

Downstream in the flow direction 11 of the gas-carrying line 2, a connecting flange 10 connects to the gas-carrying line 2 and to the fluid line 5 running in the interior 39 thereof.

The connecting flange 10 is supported (not shown in FIG. 2) on the gas-carrying line 2 by a bearing, preferably a ball bearing, radially rotatable relative to the longitudinal axis 12 thereof.

The connecting flange 10 is thereby sealed off on one side thereof relative to the gas-carrying line 2 and on the other side thereof relative to an outlet device 4, such that no compressed air 3 can escape outward into the interior of the spout-shaped tube profile 15.

Downstream in the flow direction 11 of the compressed air 3, the connecting flange 10 opens into the outlet device 4.

The fluid line 5 transporting the fluid 6 extends in the interior of the outlet device 4.

The compressed air 3 is fed in the interior of the gas-carrying line 2 in the direction toward an opening 13 of the outlet device 4 and thereby flows around the outer wall of the fluid line 5.

As is shown in FIG. 2, the outlet device 4 comprises at least two bends 45.

When the connecting flange 10 rotates according to an arrow direction 46, the outlet device 4 also rotates about the longitudinal axis 12 of the connecting flange 10 in the arrow direction 47.

The opening 13 of the outlet device 4 faces outward eccentrically relative to the longitudinal axis 12 in the direction of an arrow 48 due to the bends 45 made in the outlet device 4.

The fluid 6 is fed into the compressed air 3 for forming a mixture 14 of compressed air and fluid by means of the means 27 placed in the fluid line 5 for releasing the fluid 6 into the gas-carrying line 3.

Due to the eccentric alignment of the opening 13 of the outlet device 4, swirling 49 of the mixture 14 of compressed air and fluid arises in the interior of the spout-shaped tube profile 15.

The swirling 49 of the mixture 14 of compressed air ad fluid is applied along the longitudinal axis 12 of the connecting flange 10 in the direction toward an object 50 to be cleaned.

A valve switch 23 of a valve 8; 9, not shown, is depicted in plan view in FIG. 2 on the bottom of the housing 19.

FIG. 3 shows the housing 19 of the system 1 for outputting the mixture. In FIG. 3, the valve switches 22 and 25 and/or the compressed air valve 8 and the fluid valve 9 are each disposed offset from each other.

A valve switch 22 for compressed air 3 and a valve switch 25 for controlling the fluid flow 6 are shown on the top side of the housing 19.

The housing 19 of the system 1 for cleaning objects is penetrated by the gas-carrying line 2, in the interior 39 of which the fluid line 5 runs.

The housing 19 is pivotally supported on the pivot axis 21 of the switch lever 20.

The switch lever 20 is shown in section view in FIG. 3. A flat contact surface 24 is depicted on the bottom of the switch lever 20 in the plan view of FIG. 3.

By pivoting the switch lever 20 about the pivot axis 21, the contact surface 24 of the switch lever 20 makes contact with the valve switches 22; 25.

If the user (not shown) pivots the switch lever 20 further in the direction of an arrow 51, then the contact surface 24 of the switch lever 20 presses against the valve switch 22 of the compressed air valve 8 and simultaneously the contact surface 24 of the switch lever 20 also presses down the valve switch 25 of the fluid valve 9 when the switch lever 20 is pivoted further in the direction of the arrow 51.

By actuating the valve switches 22 and 25, the compressed air valve 8 and the fluid valve 9 are opened or closed.

FIG. 4 shows the housing 19 of the system 1 for outputting the mixture according to FIG. 3, with the difference that the pivot bearings 52 are shown on which the switch lever 20 (not shown) are supported pivotally about the pivot axis 21.

The housing 19 according to FIG. 4 differs from the housing according to FIG. 3 in that the valve switch 22 of the compressed air valve 8 is mounted on the top side of the housing 19 in the depiction of FIG. 4. The valve switch 25 of the fluid valve 9 is, in contrast, mounted on the side of the housing 19 of the system 1 for outputting the mixture.

The depiction in FIG. 5 differs from the depiction in FIG. 4 in that the valve switch 22 of the compressed air valve 8 and the valve switch 25 of the fluid valve 9 are each disposed in different planes 53; 54 having a different distance from the longitudinal axis 12 of the connecting flange 10 (not shown).

FIG. 6 corresponds approximately to the depiction of FIG. 3, with the difference that the switch lever 20 in the schematic depiction of FIG. 6 is disposed having the pivot axis 21 thereof at the top side of the housing 19, wherein the pivot axis 21 extends approximately parallel to the longitudinal axis 12 of the connecting flange 10 (not shown).

The switch lever 20 is depicted as penetrated in FIG. 6.

The switch lever 20 thereby comprises a greater material thickness in the region of the valve switch 22 of the compressed air valve 8 than in the region of the valve switch 25 of the fluid valve 9.

In addition, the valve switch 22 and the valve switch 25 are disposed transversely relative to the longitudinal axis 12 of the connecting flange 10 (not shown), contrary to the depiction in FIG. 3.

By pivoting the switch lever 20 in the arrow direction 51, the switch lever 20 actuates the valve switch 22 of the compressed air valve 8 first, due to the different material thickness of the switch lever 20. Only by pivoting the switch lever 20 further in the arrow direction 51 does the switch lever 20 make contact with the valve switches 25 of the fluid valve 9.

FIG. 7 correspond to the depiction in FIG. 6 with respect to the arrangement of the valve switches 22 and 25, with the difference that the pivot axis 21 of the switch lever 20 extends transverse to the longitudinal axis 12 of the connecting flange 10 (not shown).

The switch lever 20 is shown in cutaway in the depiction in FIG. 7.

The contact surface 24 of the switch lever 20 comprises a pedestal 55 on the bottom side of the switch lever 20.

In the region of the pedestal 55, the contact surface 24 of the switch lever 20 makes contact first with the valve switch 22 of the compressed air valve 8 when pivoting the switch lever 20 in the arrow direction 51.

Only by pivoting the switch lever 20 further in the arrow direction 51 does the contact surface 24 of the switch lever 20 also make contact with the valve switch 25 of the fluid valve 9.

The depiction in FIG. 8 corresponds to the depiction in FIG. 7, with the difference that two separate switch levers 56; 57 are provided.

The switch lever 56 actuates the compressed air valve 8, while the switch lever 57 controls the fluid valve 9.

The switch lever 57 is implemented so as to overlap the switch lever 56.

When pressing down the switch lever 57 in the arrow direction 50, the switch lever 57 pushes the switch lever 56 along, so that the fluid valve 9 can only be actuated when the compressed air valve 8 is actuated simultaneously.

A tongue 58 of the switch lever 56 of the compressed air valve 8 reaches under the switch lever 57 of the fluid valve 9.

Because of this design, the compressed air valve 8 can be actuated separately and individually, independently of the fluid valve 9.

The fluid valve 9, in contrast, can only be actuated and opened together with the compressed air valve 8. In this manner, it is ensured that the fluid, preferably the cleaning agent, can be applied to the object 50 to be cleaned only in the form of a mixture of compressed air and fluid.

FIG. 9 corresponds to FIG. 8, with the difference that the schematic depiction in FIG. 9 shows two switch levers 56; 57 that can be actuated individually and independently of each other.

FIG. 10 shows a gas-carrying line 2 comprising a segment 68 comprising the outlet device 4. Said segment 68 is separated from the other, upstream segment 69 of the gas-carrying line 2.

The segment 68 of the gas-carrying line 2 comprising the outlet device 4 is displaceable in the axial direction against the other, upstream segment 69 of the gas-carrying line 2. The spacing between end faces facing each other of the other, upstream segment 69 of the gas-carrying line and the segment 68 of the gas-carrying line 2 comprising the outlet device 4 can be axially changed.

The other, upstream segment 69 and the segment 68 comprising the outlet device 4 are designed for connecting axially to each other in a gas-tight manner by means of a connecting flange 10.

The end faces of the two segments 68; 69 of the gas-carrying line 2 facing each other protrude into the connecting flange 10. The segment 68 of the gas-carrying line 2 comprising the outlet device 4 is disposed in the interior of the connecting flange 10 for displacing relative to the other segment 69 of the gas-carrying line 2 in a gas-tight manner. For sealing the segment 68 comprising the outlet device 4 against the connecting flange 10, a sealing means can be disposed on the inner wall of the connecting flange 10.

The fluid line 5 comprising no interruptions extends in the interior of the gas-carrying line 2. The fluid line 5 bridges the end faces of the segments 68 and 69 of the gas-carrying line in the interior of the connecting flange 10.

The segments 68; 69 running in the interior of the connecting flange 10 and the fluid line 5 are shown as dashed lines.

FIG. 10 further shows that the outlet device 4 comprises a body 59 for mechanically cleaning the surface 50.

The body 59 is implemented as a brush. The body 59 can also be a sponge or a wire construct for mechanically cleaning. The body 59 can also be a different element for mechanically cleaning a surface 50.

The body 59 is disposed on the outlet device 4.

The outlet device 4 comprises a segment 60 extending along the longitudinal axis 12 of the gas-carrying line 2. The body 59 for cleaning the surface 50 is disposed on the segment 60 of the outlet device 4 extending along the longitudinal axis 12 of the gas-carrying line 2.

The end 66 of the body 59 for cleaning the surface 50 downstream in the axial direction does not protrude beyond the downstream end 67 of the outlet device 4.

The outlet device 4 further comprises a further segment 61 connected to the segment 60 extending along the longitudinal axis 12 of the gas-carrying line 2 and extending eccentric to the longitudinal axis 12 of the gas-carrying line 2.

The body 59 for cleaning the surface 50 (not shown) can also be disposed at the end 62 of the further segment 61 connected downstream and running eccentric to the longitudinal axis 12 of the gas-carrying line 2.

The outlet device 4 is connected to the connecting flange 10. A rotation of the connecting flange 4 brings about a rotation of the outlet device 4. The rotation of the outlet device 4 brings about rotation with the outlet device 4 of the body 59 disposed on the outlet device 4 for cleaning the surface 50. The body 59 for cleaning the surface 50 rotates in the interior of an enclosure 63 radially enclosing the outlet device 4.

An adapter (not shown) is disposed at the end 64 of the enclosure 63. The enclosure 63 is implemented as an enclosing tube profile.

The enclosure 63 is radially rotatable relative to the housing 19 (not shown). Conversely, the housing 19 (not shown) can be disposed radially rotatably relative to the enclosure 63.

The arrangement of the body 59 for mechanically cleaning the surface 50 has been found to be advantageous because the cleaning of the surface 50 by means of a mixture 14 of gas and fluid can be supported in this manner by mechanically cleaning by means of a body 59 for mechanically cleaning the surface 50.

REFERENCE NUMERALS

1. System for outputting mixtures
2. Gas-carrying line
3. Compressed air
4. Outlet device
5. Fluid line
6. Fluid
7. Device for outputting mixture
8. Compressed air valve
9. Fluid valve
10. Connecting flange
11. Flow direction of the air
12. longitudinal axis of the connecting flange
13. Opening
14. Mixture of compressed air and fluid
15. Spout-shaped tube profile
16. Additional flange
17. Suction tube
18. Handle
19. Housing
20. Switch lever
21. Pivot axis of the switch lever
22. Valve switch
23. Valve switch
24. Contact surface
25. Valve switch
26. Fluid tank
27. Means for releasing fluid
30. Outlet opening
34. Top end
35. Filter
36. Line element
37. Connecting flange
38. Inlet
39. Interior of the compressed air line
40. Outlet
41. Supply line
42. Manometer
43. Generator
44. Clamp
45. Bend
46. Arrow direction
47. Arrow direction
48. Arrow
49. Swirling
50. Object
51. Arrow
52. Pivot bearing
53. Plane
54. Plane
55. Pedestal
56. Switch lever
57. Switch lever
58. Tongue
59. Body
60. Segment extending along the longitudinal axis of the gas-carrying line
61. Further segment running eccentric to the longitudinal axis of the gas-carrying line
62. End of the further segment running eccentric to the longitudinal axis of the gas-carrying line connected downstream
63. Enclosure
64. End of enclosure
66. Downstream end of the body
67. Downstream end of the outlet device
68. Segments
69. Segment The invention is claimed:

1. A system for outputting a mixture generated from at least one gas flow and at least one fluid flow onto a surface, the mixture being fed into a device for outputting the mixture, characterized in that the device for outputting the mixture comprises a gas-carrying line, a fluid-carrying line extending axially in the interior thereof, and the gas-carrying line and the fluid-carrying line are implemented as an outlet device for outputting the mixture, wherein the outlet device is further implemented so as to be eccentrically rotatable about the longitudinal axis of the gas-carrying line, and further comprises a body for cleaning the surface, wherein the system has a housing, having a first and second switch lever engaging with each other, where in the first switch lever is implemented so as to overlap the second switch lever.

2. The system for outputting the mixture according to claim 1, characterized in that the outlet device comprises a segment extending along the longitudinal axis of the gas-carrying line and a second segment connected downstream thereof extending eccentric to the longitudinal axis of the gas-carrying line, wherein the body for cleaning the surface is disposed at the end of the second segment and being implemented having a brush shape.

3. The system for outputting the mixture according to claim 1, characterized in that the device for outputting the mixture comprises an enclosure radially enclosing the outlet device, wherein the enclosure is implemented to enclose an opening at the end of the outlet device, and an adapter can further be attached to the end of the outlet device thereof, and wherein the enclosure is radially rotatable relative to the housing or the housing is radially rotatable relative to the enclosure, wherein an end of the adapter does not protrude beyond a downstream end of the tube profile.

4. The system for outputting the mixture according to claim 1, characterized in that a segment of the gas-carrying line comprising the outlet device is separated from the other, upstream segment of the gas-carrying line and both segments are designed for connecting in a gas-tight manner by means of a connecting flange, wherein the segment of the gas-carrying line comprising the outlet device can be displaced against the other, upstream segment of the gas-carrying line, and the segment of the gas-carrying line comprising the outlet device is implemented for displacing relative to the inner wall of the connecting flange in a gas-tight manner.

5. The system for outputting the mixture according to claim 1, characterized in that the mixture can be released from the outlet device in a spiral shape, wherein the outlet device is rotatably supported at an upstream end thereof on a connecting flange, and wherein the outlet device can be induced to rotate about its longitudinal axis thereof by releasing the mixture from a downstream end of the outlet device, wherein the connecting flange is connected upstream to the gas-carrying line implemented for receiving the fluid-carrying line wherein the mixture can be generated in the device for outputting the mixture, where the outlet device comprises at least one curve.

6. The system for outputting a mixture according to claim 1, characterized in that at least one valve device is disposed, by means of which the gas flow and/or the fluid flow can be regulated.

7. The system for outputting a mixture according to claim 1, characterized in that the fluid line can be fed with the fluid from a fluid tank to which pressure can be applied by means of the gas flow, wherein the gas is present in the form of compressed air, provided by a generator.

8. The system for outputting a mixture according to claim 1, characterized in that the gas-carrying line comprises an inlet by means of which a fluid line can be inserted into the gas-carrying line, wherein the gas-carrying line comprises an outlet for connecting to the fluid tank by means of a supply line.

9. The system for outputting a mixture according to claim 1, characterized in that the at least one valve and/or the fluid line and/or the gas-carrying line are received in a housing, wherein the housing comprises a handle for guiding the device for outputting the mixture, and the housing and/or the handle and/or an enclosure comprise a heated handle profile, and an exhaust tube of an exhaust device can be connected to the device for outputting the mixture.

10. The system for outputting a mixture according to claim 1, characterized in that the line carrying the fluid comprises means for releasing fluid into the outlet device, wherein vacuum can be generated by the gas flowing past the means for releasing fluid into the outlet device, wherein the fluid is a cleaning fluid.

11. The system for outputting a mixture according to claim 10, wherein valve switches lie along an axis with respect to each other that is transverse to the longitudinal axis of the gas-carrying line, or the valve switches lie along an axis with respect to each other that is parallel to the longitudinal axis of the gas-carrying line, and wherein the at least one valve switch can be actuated by means of at least one switch lever, and the valve switches are disposed on different planes relative to each other.

12. The system for outputting a mixture according to claim 1, characterized by at least one valve controlling the fluid flow and at least one valve controlling the gas flow, wherein at least one valve switch is provided for actuating the valves.

* * * * *